US011254407B2

(12) United States Patent
Koyano

(10) Patent No.: US 11,254,407 B2
(45) Date of Patent: Feb. 22, 2022

(54) WATERCRAFT

(71) Applicant: YAMAHA HATSUDOKI KABUSHIKI KAISHA, Iwata (JP)

(72) Inventor: Satoshi Koyano, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 2 days.

(21) Appl. No.: 16/918,003

(22) Filed: Jul. 1, 2020

(65) Prior Publication Data

US 2021/0001971 A1 Jan. 7, 2021

(30) Foreign Application Priority Data

Jul. 5, 2019 (JP) ..... JP2019-126027

(51) Int. Cl.

| | |
|---|---|
| ***B63H 25/46*** | (2006.01) |
| ***B63H 11/04*** | (2006.01) |
| ***B63H 11/11*** | (2006.01) |
| ***B63H 25/02*** | (2006.01) |
| ***B63H 11/113*** | (2006.01) |
| *B63H 11/00* | (2006.01) |

(52) U.S. Cl.

CPC ..... *B63H 25/46* (2013.01); *B63H 11/04* (2013.01); *B63H 11/113* (2013.01); *B63H 25/02* (2013.01); *B63H 2011/006* (2013.01); *B63H 2011/008* (2013.01); *B63H 2025/022* (2013.01)

(58) Field of Classification Search

CPC ..... B63H 25/00; B63H 25/02; B63H 25/46; B63H 11/00; B63H 11/113; B63H 2011/006; B63H 2011/008; B63H 2025/022; B63H 11/04

USPC ..... 114/150

See application file for complete search history.

(56) References Cited

U.S. PATENT DOCUMENTS

| | | | | |
|---|---|---|---|---|
| 7,320,629 | B2 * | 1/2008 | Okuyama | B63H 25/02 114/150 |
| 10,661,872 | B1 * | 5/2020 | Ito | B63H 25/24 |
| 2018/0273152 | A1 | 9/2018 | Koyano et al. | |

FOREIGN PATENT DOCUMENTS

| | | | |
|---|---|---|---|
| JP | 2018-158628 | A | 10/2018 |

* cited by examiner

*Primary Examiner* — Lars A Olson

(74) *Attorney, Agent, or Firm* — Keating and Bennett, LLP

(57) ABSTRACT

A controller receives a signal indicating an operating amount and an operating direction of a steering member. When the operating amount of the steering member is greater than or equal to a steering threshold, the controller causes right and left propulsion devices to generate thrusts oriented in opposite directions in a back-and-forth direction such that a vessel body is turned in a corresponding direction to the operating direction of the steering member.

8 Claims, 13 Drawing Sheets

WATERCRAFT

CROSS REFERENCE TO RELATED APPLICATIONS

This application claims the benefit of priority to Japanese Patent Application No. 2019-126027 filed on Jul. 5, 2019. The entire contents of this application are hereby incorporated herein by reference.

BACKGROUND OF THE INVENTION

1. Field of the Invention

The present invention relates to a watercraft.

2. Description of the Related Art

There is a type of watercraft turned right and left by changing directions of thrusts generated by right and left propulsion devices. For example, a watercraft described in Japan Laid-open Patent Application Publication No. 2018-158628 includes a left jet propulsion device and a right jet propulsion device. The left jet propulsion device includes a reverse gate and a nozzle. When the reverse gate is set in a forward moving position, the left jet propulsion device generates a thrust oriented in a forward moving direction. When the reverse gate is set in a backward moving position, a stream of water spouted from the left jet propulsion device is changed to flow forward. Accordingly, the left jet propulsion device generates a thrust oriented in a backward moving direction. The nozzle changes the direction of the stream of water spouted from the left propulsion device to the right and left. The right jet propulsion device is configured in a similar manner to the left jet propulsion device.

In the watercraft described in Japan Laid-open Patent Application Publication No. 2018-158628, the directions of the nozzles of the right and left jet propulsion devices are changed right and left in accordance with a direction in which a steering member is operated. For example, when the steering member is operated during forward movement of the watercraft, the right and left jet propulsion devices are configured such that the directions of the nozzles are changed right and left while the reverse gates are kept set in the forward moving positions. Accordingly, the watercraft is turned in accordance with the operating direction of the steering member.

The watercraft described above is limited in enhancement of the turning performance by the maximum rudder angles of the nozzles and the magnitudes of thrusts generated by the right and left propulsion devices. Because of this, it is not easy to enhance the turning performance of the watercraft. For example, it is not easy to reduce a time lag between completion of turning the steering member and onset of turning the watercraft.

SUMMARY OF THE INVENTION

Preferred embodiments of the present invention provide enhanced turning performance of a watercraft.

According to a preferred embodiment of the present disclosure, a watercraft includes a vessel body, a left propulsion device, a right propulsion device, a steering member, a sensor, and a controller. The left propulsion device is attached to the vessel body. The right propulsion device is attached to the vessel body. The steering member is operable from a neutral position in a left turning direction and a right turning direction. The sensor outputs a signal indicating an operating amount and an operating direction of the steering member operated from the neutral position. The controller is in communication with the left propulsion device, the right propulsion device, and the sensor. The controller receives the signal indicating the operating amount and the operating direction of the steering member. When the operating amount of the steering member is greater than or equal to a steering threshold, the controller causes the right and left propulsion devices to generate thrusts oriented in opposite directions in a back-and-forth direction such that the vessel body is turned in a direction corresponding to the operating direction of the steering member.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
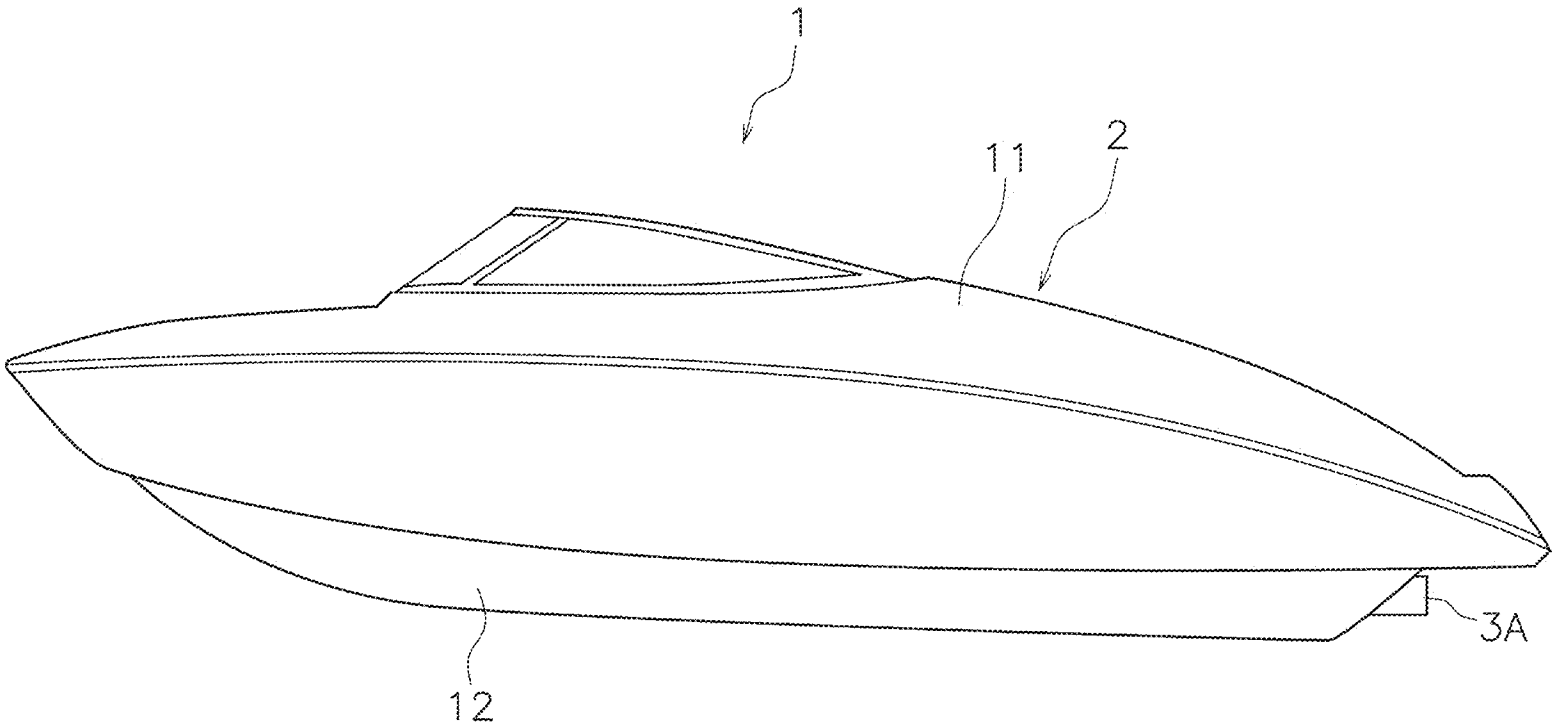
FIG. 1 is a side view of a watercraft according to a preferred embodiment of the present invention.
Figure 2:
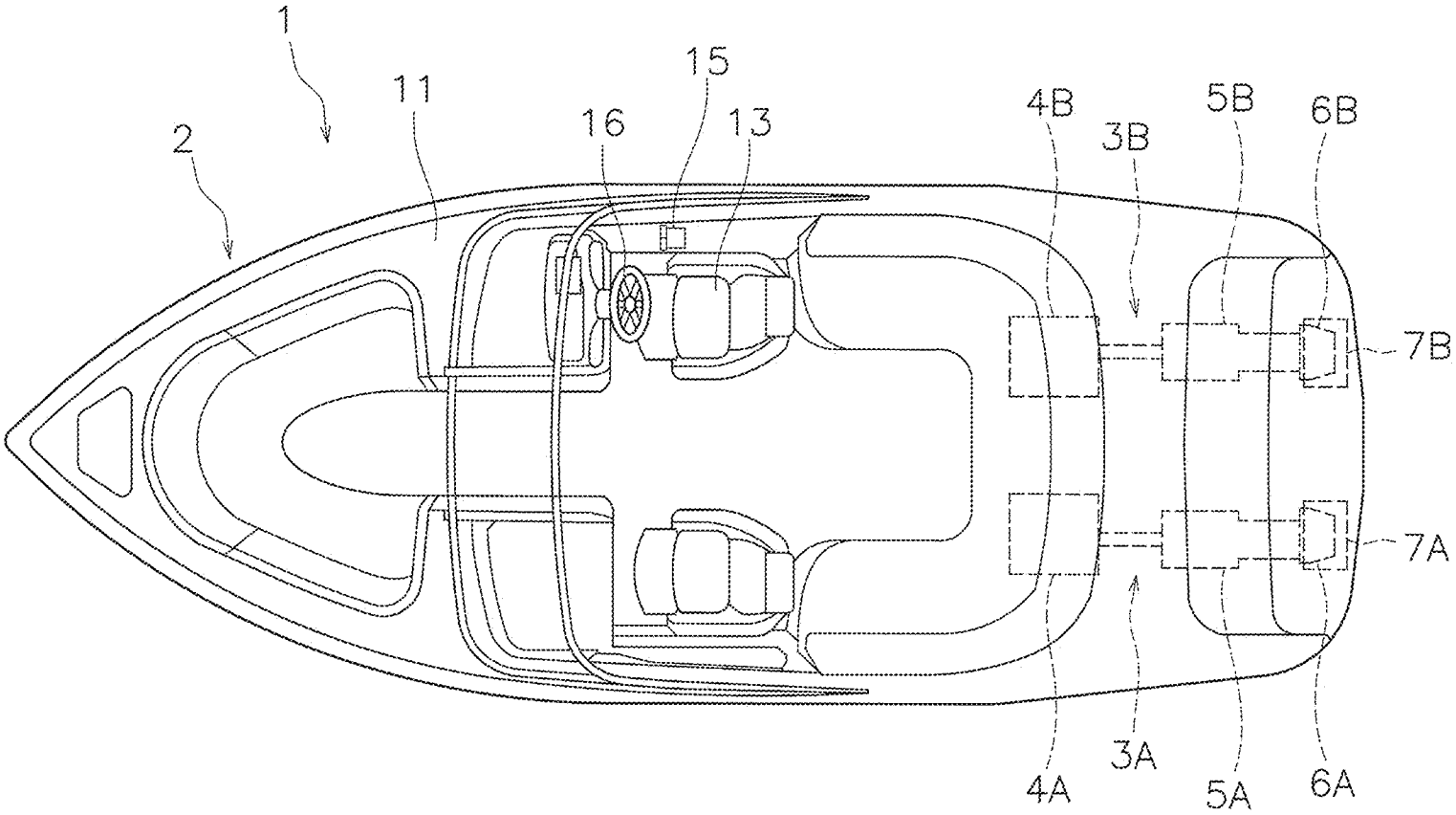
FIG. 2 is a top view of the watercraft.

Watercrafts according to preferred embodiments will be hereinafter explained with reference to drawings. FIG. 1 is a side view of a watercraft 1 according to a preferred embodiment of the present invention. FIG. 2 is a top view of the watercraft 1. In the present preferred embodiment, the watercraft 1 is a jetboat or a sport boat, for example.

The watercraft 1 includes a vessel body 2, a left propulsion device 3A, and a right propulsion device 3B. The vessel body 2 includes a deck 11 and a hull 12. The hull 12 is disposed below the deck 11. An operator seat 13 is disposed on the deck 11. The left and right propulsion devices 3A and 3B are attached to the vessel body 2. The left and right propulsion devices 3A and 3B are jet propulsion devices, for example.

Figure 3:
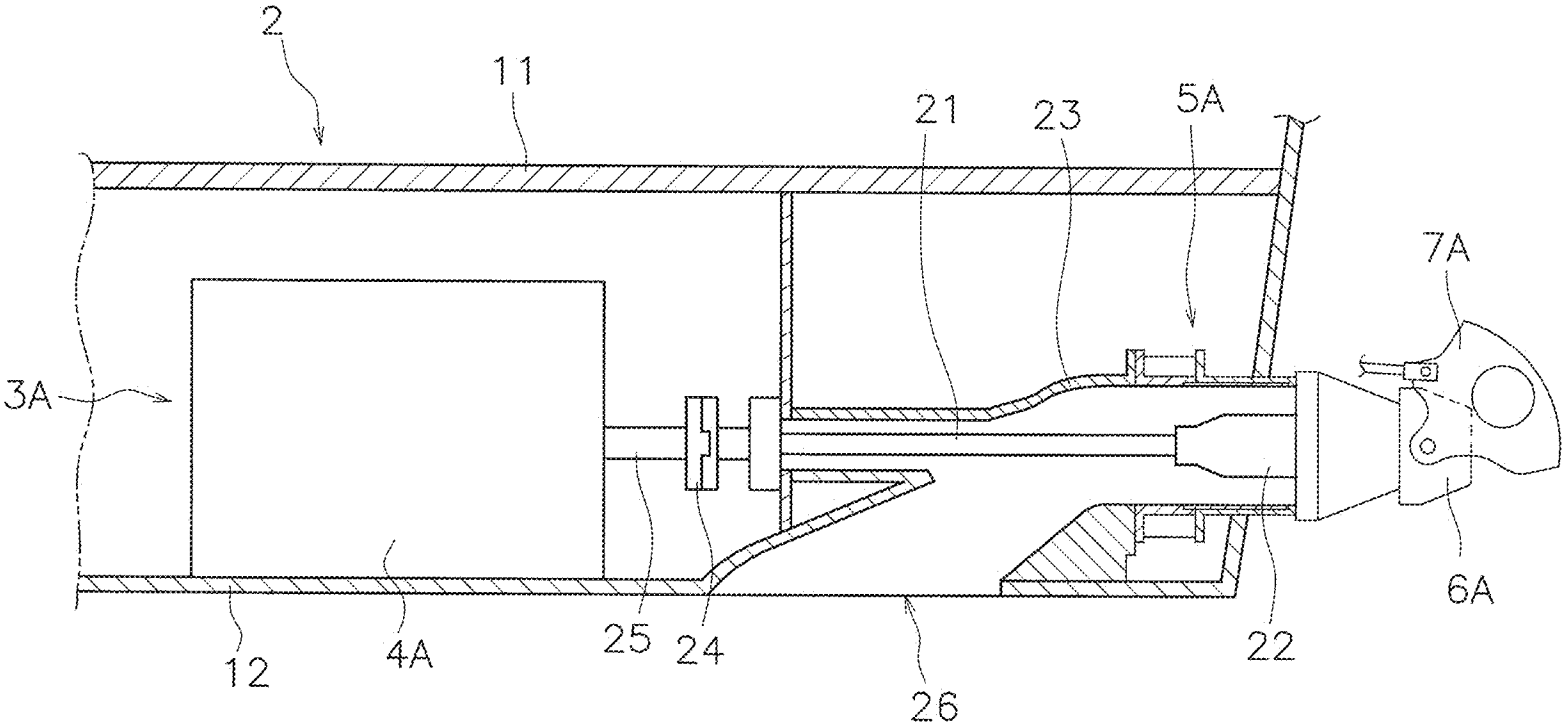
FIG. 3 is a cross-sectional side view of the watercraft.

FIG. 3 is a cross-sectional side view of the watercraft 1. FIG. 3 shows a portion of the left propulsion device 3A in a cross-sectional representation. As shown in FIG. 3, the left propulsion device 3A is accommodated in the vessel body 2. The left propulsion device 3A includes a left engine 4A, a first jet pump 5A, a first nozzle 6A, and a first reverse gate 7A. The left engine 4A is connected to the first jet pump 5A. The first jet pump 5A is driven by the left engine 4A in order to suck in and spout out water surrounding the vessel body 2. Accordingly, the first jet pump 5A generates a thrust to move the vessel body 2.

The first jet pump 5A includes a drive shaft 21, an impeller 22, and a pump housing 23. The drive shaft 21 is connected to an output shaft 25 of the left engine 4A through a coupling 24. The impeller 22 is connected to the drive shaft 21. The impeller 22 is disposed inside the pump housing 23. The impeller 22 is rotated together with the drive shaft 21 in order to draw in water through a water suction port 26. The impeller 22 backwardly spouts the drawn in water through a spout port of the pump housing 23.

The first nozzle 6A is disposed behind the first jet pump 5A. The first nozzle 6A is disposed to be swingable right and left. The first nozzle 6A changes the direction of water spouted from the first jet pump 5A in a right-and-left direction. The first reverse gate 7A is disposed behind the first nozzle 6A. The first reverse gate 7A is disposed such that the position thereof is switchable between a forward moving position and a backward moving position. When the position of the first reverse gate 7A is switched between the forward moving position and the backward moving position, the direction of the stream of water spouted from the first jet pump 5A is changed. Movement of the watercraft 1 is thus switched between forward movement and backward movement.

The right propulsion device 3B is configured in a similar manner to the left propulsion device 3A. As shown in FIG. 2, the right propulsion device 3B includes a right engine 4B, a second jet pump 5B, a second nozzle 6B, and a second reverse gate 7B. The right engine 4B, the second jet pump 5B, the second nozzle 6B, and the second reverse gate 7B are configured in a similar manner to the left engine 4A, the first jet pump 5A, the first nozzle 6A, and the first reverse gate 7A, respectively. Thus, detailed explanation thereof will be hereinafter omitted.

Figure 4:
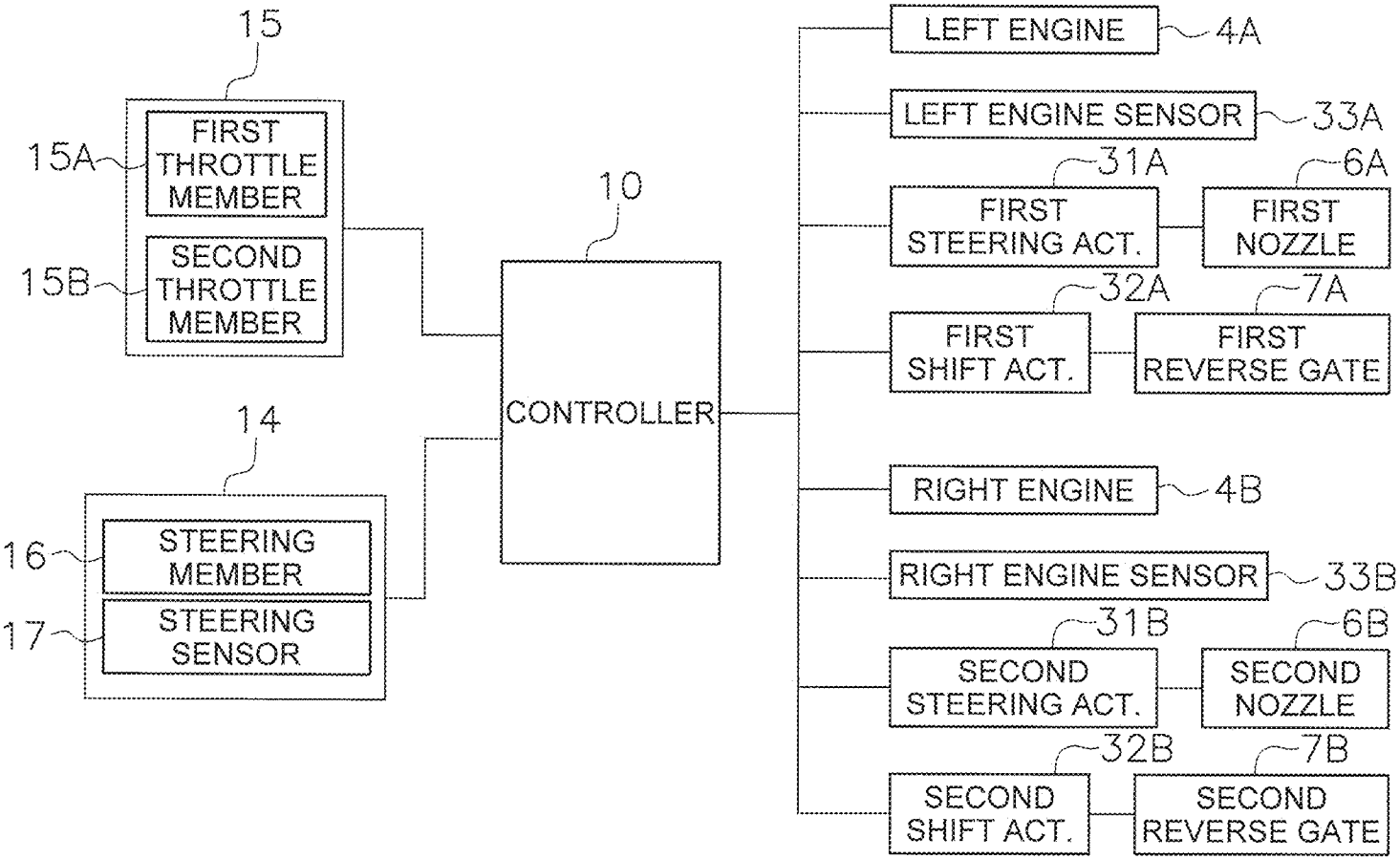
FIG. 4 is a schematic diagram of a system for operating the watercraft.

FIG. 4 is a schematic diagram of a system to operate the watercraft 1. As shown in FIG. 4, the watercraft 1 includes a controller 10. The controller 10 includes a processor such as a CPU and memories such as a RAM and a ROM. The controller 10 is configured or programmed to control the watercraft 1. It should be noted that the controller 10 may include a plurality of controllers separate from each other. Alternatively, the controller 10 may be a single device.

The watercraft 1 includes a first steering actuator 31A and a first shift actuator 32A. The controller 10 is connected to the left engine 4A, the first steering actuator 31A, and the first shift actuator 32A in a communicable manner.

The first steering actuator 31A is connected to the first nozzle 6A of the left propulsion device 3A. The first steering actuator 31A changes a nozzle angle of the first nozzle 6A. The nozzle angle is an angle of the axis extending backward from the first nozzle 6A with respect to the back-and-forth direction of the watercraft 1. The first steering actuator 31A is, for instance, an electric motor. Alternatively, the first steering actuator 31A may be another type of actuator such as a hydraulic cylinder.

The first shift actuator 32A is connected to the first reverse gate 7A of the left propulsion device 3A. The first shift actuator 32A switches the position of the first reverse gate 7A between the forward moving position and the backward moving position. The first shift actuator 32A is, for instance, an electric motor. Alternatively, the first shift actuator 32A may be another type of actuator such as a hydraulic cylinder.

The watercraft 1 includes a second steering actuator 31B and a second shift actuator 32B. The second steering actuator 31B is connected to the second nozzle 6B of the right propulsion device 3B. The second shift actuator 32B is connected to the second reverse gate 7B of the right propulsion device 3B. The second steering actuator 31B and the second shift actuator 32B are configured in a similar manner to the first steering actuator 31A and the first shift actuator 32A, both of which are described above. The controller 10 is connected to the second steering actuator 31B and the second shift actuator 32B in a communicable manner.

The watercraft 1 includes a steering device 14 and a throttle device 15. The controller 10 is connected to the steering device 14 and the throttle device 15 in a communicable manner. The throttle device 15 is disposed at the operator seat 13. The throttle device 15 is operated to regulate an output from each of the left or right engine 4A, 4B and to switch between forward movement and backward movement. The throttle device 15 includes a first throttle member 15A and a second throttle member 15B. Each of the first or second throttle member 15A, 15B may be, for example, a lever. However, each of the first or second throttle member 15A, 15B may be a member different from a lever, such as a switch.

Each of the first or second throttle member 15A, 15B is operable from a neutral position in directions corresponding to forward movement and backward movement. The throttle device 15 outputs a signal indicating the operating amount and the operating direction of each of the first or second throttle member 15A, 15B. The controller 10 controls the rotational speed of the left engine 4A in accordance with the operating amount of the first throttle member 15A. The controller 10 increases the rotational speed of the left engine 4A with an increase in the operating amount of the first throttle member 15A. The controller 10 controls the rotational speed of the right engine 4B in accordance with the operating amount of the second throttle member 15B. The controller 10 increases the rotational speed of the right engine 4B with an increase in the operating amount of the second throttle member 15B.

The watercraft 1 includes a left engine sensor 33A and a right engine sensor 33B. The left and right engine sensors 33A and 33B are connected to the controller 10 in a communicable manner. The left engine sensor 33A outputs a signal indicating the engine rotational speed of the left engine 4A to the controller 10. The right engine sensor 33B outputs a signal indicating the engine rotational speed of the right engine 4B to the controller 10.

The controller 10 controls the first shift actuator 32A in accordance with the operating direction of the first throttle member 15A. Accordingly, the direction of the thrust generated by the left propulsion device 3A is switched between the forward moving direction and the backward moving direction. The controller 10 controls the second shift actuator 32B in accordance with the operating direction of the second throttle member 15B. Accordingly, the direction of the thrust generated by the right propulsion device 3B is switched between the forward moving direction and the backward moving direction.

Figure 5:
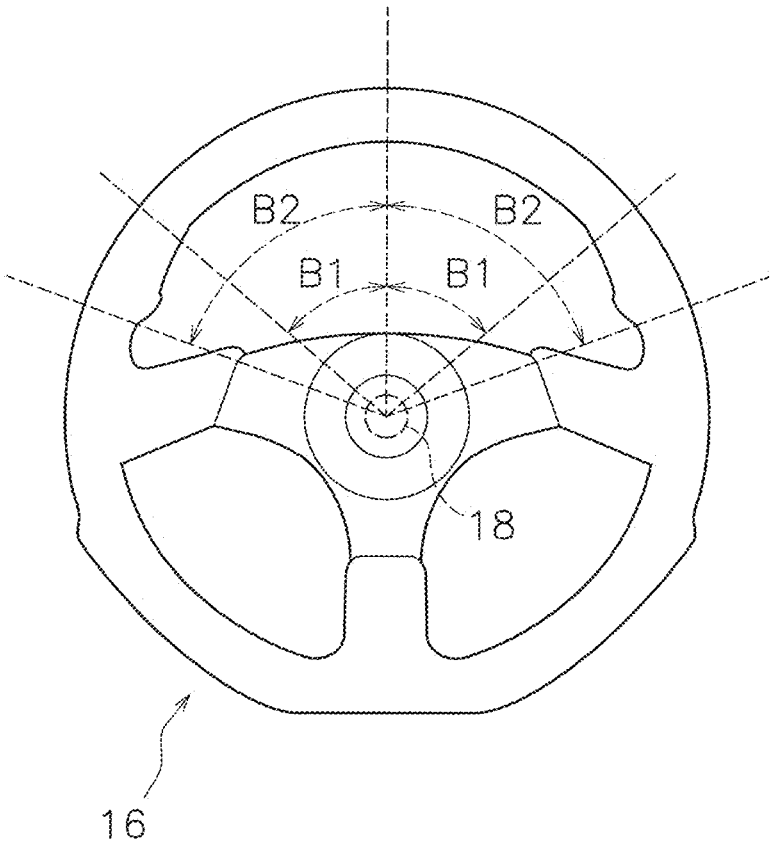
FIG. 5 is a view of a steering member.

The steering device 14 is disposed at the operator seat 13. The steering device 14 includes a steering member 16 and a steering sensor 17. FIG. 5 is a view of the steering member 16. The steering member 16 is turnable about a steering shaft 18. The steering member 16 is operable from a neutral position shown in FIG. 5 in directions corresponding to left and right turns. The steering member 16 is operated to steer the watercraft 1. In other words, the controller 10 controls a bow direction of the watercraft 1 in accordance with the operation of the steering member 16.

The neutral position is an operating position of the steering member 16 to straightly move the watercraft 1.

The steering sensor 17 outputs a signal indicating a steering angle to the controller 10. The steering angle indicates the operating amount and the operating direction of the steering member 16 from the neutral position. The steering sensor 17 may be, for instance, a potentiometer. However, the steering sensor 17 may be another type of sensor such as an optical sensor or a magnetic sensor.

The controller 10 controls the first steering actuator 31A in order to control the nozzle angle of the left propulsion device 3A. The controller 10 controls the second steering actuator 31B in order to control the nozzle angle of the right propulsion device 3B. The bow direction of the watercraft 1 is thus changed to the right and left. Steering control of the watercraft 1 executed by the controller 10 will be hereinafter explained.

Figure 6:
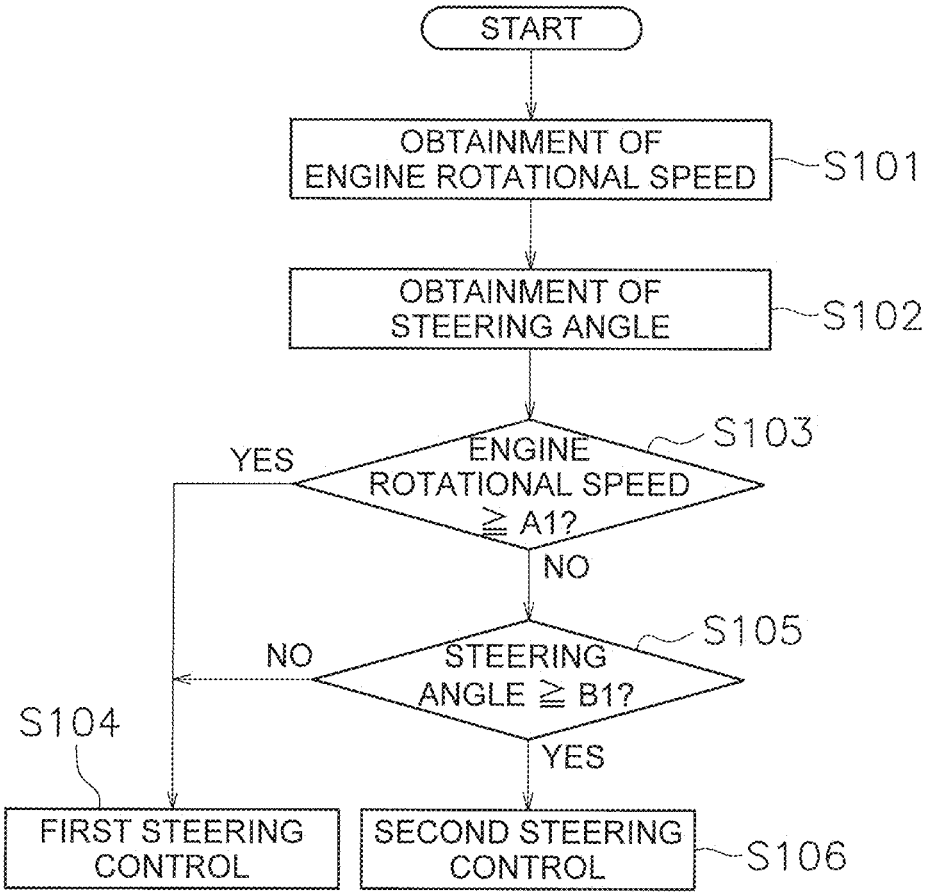
FIG. 6 is a flowchart showing processes of a steering control.

FIG. 6 is a flowchart showing processes performed during the steering control. As shown in FIG. 6, in step S101, the controller 10 obtains the engine rotational speeds. The controller 10 obtains the engine rotational speeds of the left and right engines 4A and 4B based on the signals received from the left and right engine sensors 33A and 33B. In step S102, the controller 10 obtains the steering angle. The controller 10 obtains the steering angle based on the signal received from the steering sensor 17.

In step S103, the controller 10 determines whether or not the engine rotational speed is greater than or equal to a speed threshold A1. The controller 10 determines "YES" in step S103 when at least one of the engine rotational speeds of the left and right engines 4A and 4B is greater than or equal to the speed threshold A1. However, the controller 10 may determine "YES" in step S103 when both the engine rotational speeds of the left and right engines 4A and 4B are greater than or equal to the speed threshold A1.

The speed threshold A1 may be set based on a value of the engine rotational speed at which the watercraft 1 is turned in accordance with the operation of the steering member 16 at low responsiveness. When the engine rotational speed is greater than or equal to the speed threshold A1, the process proceeds to step S104.

Figure 7A:
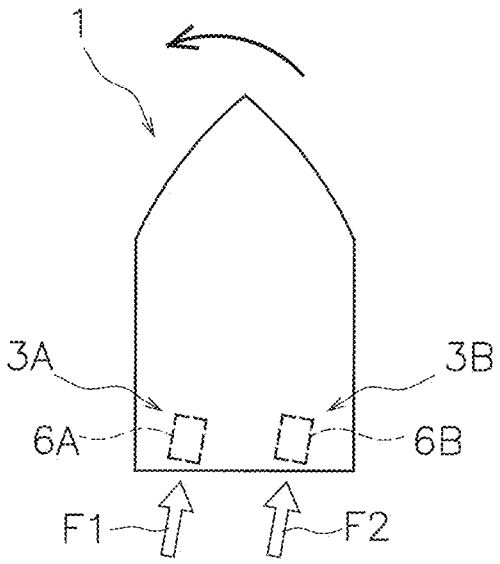
FIG. 7A is a diagram showing thrusts and nozzle angles of right and left propulsion devices during a first steering control.
Figure 7B:
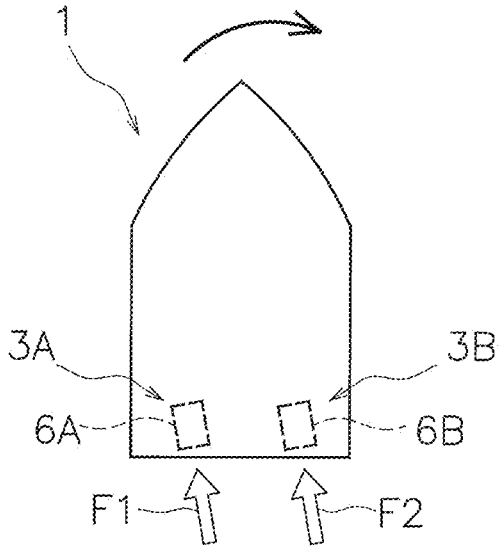
FIG. 7B is a diagram showing the thrusts and the nozzle angles of the right and left propulsion devices during the first steering control.

In step S104, the controller 10 executes a first steering control. During the first steering control, the controller 10 causes the left and right propulsion devices 3A and 3B to generate thrusts oriented in an identical direction. For example, as shown in FIGS. 7A and 7B, the controller 10 causes the left and right propulsion devices 3A and 3B to generate thrusts F1 and F2 oriented in the forward moving direction, respectively. Additionally, the controller 10 causes the left and right propulsion devices 3A and 3B to change the directions of the thrusts F1 and F2 in the right-and-left direction in accordance with the steering angle. The controller 10 changes the nozzle angles of the left and right propulsion devices 3A and 3B in accordance with the steering angle.

FIG. 7A is a schematic diagram showing the watercraft 1 when the steering member 16 is operated in the left turning direction during the first steering control. As shown in FIG. 7A, when the steering member 16 is operated in the left turning direction, the controller 10 sets the nozzle angles of the left and right propulsion devices 3A and 3B to open leftward. The controller 10 increases the nozzle angles of the left and right propulsion devices 3A and 3B leftward with an increase in the steering angle in the left turning direction. Accordingly, the watercraft 1 is turned leftward in accordance with the operation of the steering member 16.

FIG. 7B is a schematic diagram showing the watercraft 1 when the steering member 16 is operated in the right turning direction during the first steering control. As shown in FIG. 7B, when the steering member 16 is operated in the right turning direction, the controller 10 sets the nozzle angles of the left and right propulsion devices 3A and 3B to open rightward. The controller 10 increases the nozzle angles of the left and right propulsion devices 3A and 3B rightward with an increase in the steering angle in the right turning direction. Accordingly, the watercraft 1 is turned rightward in accordance with the operation of the steering member 16.

As shown in FIG. 5, the steering member 16 is operable from the neutral position to a position corresponding to a maximum angle B2 in the left turning direction. Likewise, the steering member 16 is operable from the neutral position to a position corresponding to a maximum angle B2 in the right turning direction. During the first steering control, the controller 10 controls the nozzle angles of the left and right propulsion devices 3A and 3B in accordance with the steering angle over the entire range of the steering angle between the maximum left turning directional angle B2 and the maximum right turning directional angle B2.

In step S103, when the engine rotational speed is less than the speed threshold A1, the process proceeds to step S105. In step S105, the controller 10 determines whether or not the steering angle is greater than or equal to a steering threshold B1. The steering threshold B1 may be set based on a value of the steering angle at which the watercraft 1 is turned in accordance with the operation of the steering member 16 at low responsiveness when the engine rotational speed is less than the speed threshold A1. When the steering angle is not greater than or equal to the steering threshold B1, the process proceeds to step S104. In other words, when the steering angle is less than the steering threshold B1, the controller 10 causes the watercraft 1 to turn during the first steering control described above.

In step S105, when the steering angle is greater than or equal to the steering threshold B1, the process proceeds to step S106. In step S106, the controller 10 executes the second steering control. During the second steering control, the controller 10 causes the left and right propulsion devices 3A and 3B to generate the thrusts F1 and F2 oriented in opposite directions in the back-and-forth direction such that the watercraft 1 is turned in a direction corresponding to the operating direction of the steering member 16.

Figure 8A:
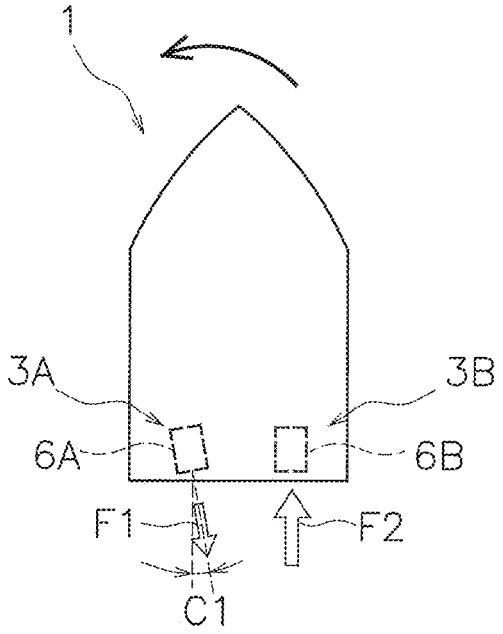
FIG. 8A is a diagram showing the thrusts and the nozzle angles of the right and left propulsion devices during a second steering control.

FIG. 8A is a schematic diagram showing the watercraft 1 when the steering member 16 is operated in the left turning direction during the second steering control. As shown in FIG. 8A, when the steering member 16 is operated in the left turning direction, the controller 10 causes the right propulsion device 3B to generate the thrust F2 for forward movement and causes the left propulsion device 3A to generate the thrust F1 for backward movement. Additionally, the controller 10 sets the nozzle angle of the left propulsion device 3A to a predetermined angle C1 opening rightward. Accordingly, the watercraft 1 is turned leftward.

Figure 8B:
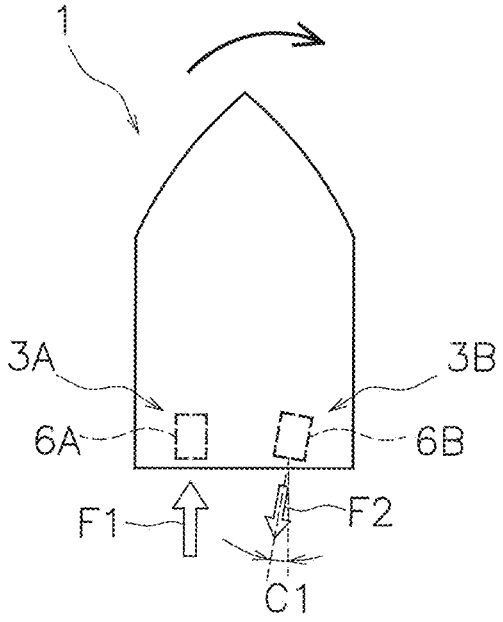
FIG. 8B is a diagram showing the thrusts and the nozzle angles of the right and left propulsion devices during the second steering control.

FIG. 8B is a schematic diagram showing the watercraft 1 when the steering member 16 is operated in the right turning direction during the second steering control. As shown in FIG. 8B, when the steering member 16 is operated in the right turning direction, the controller 10 causes the left propulsion device 3A to generate the thrust F1 for forward movement and causes the right propulsion device 3B to generate the thrust F2 for backward movement. Additionally, the controller 10 sets the nozzle angle of the right propulsion device 3B to a predetermined angle C1 opening leftward. Accordingly, the watercraft 1 is turned rightward.

Besides during the second steering control, regardless of the operating amounts of the first and second throttle members 15A and 15B, the controller 10 keeps the engine rotational speed of the left engine 4A constant at a first rotational speed while keeping the engine rotational speed of the right engine 4B constant at a second rotational speed. The second rotational speed is less than the first rotational speed when the left propulsion device 3A generates a thrust for forward movement and the right propulsion device 3B generates a thrust for backward movement. The first rotational speed is less than the second rotational speed when the right propulsion device 3B generates a thrust for forward movement and the left propulsion device 3A generates a thrust for backward movement. In other words, during the second steering control, the controller 10 sets the magnitude of a thrust generated by one propulsion device for backward movement to be less than that of a thrust generated by the other propulsion device for forward movement.

Figure 9A:
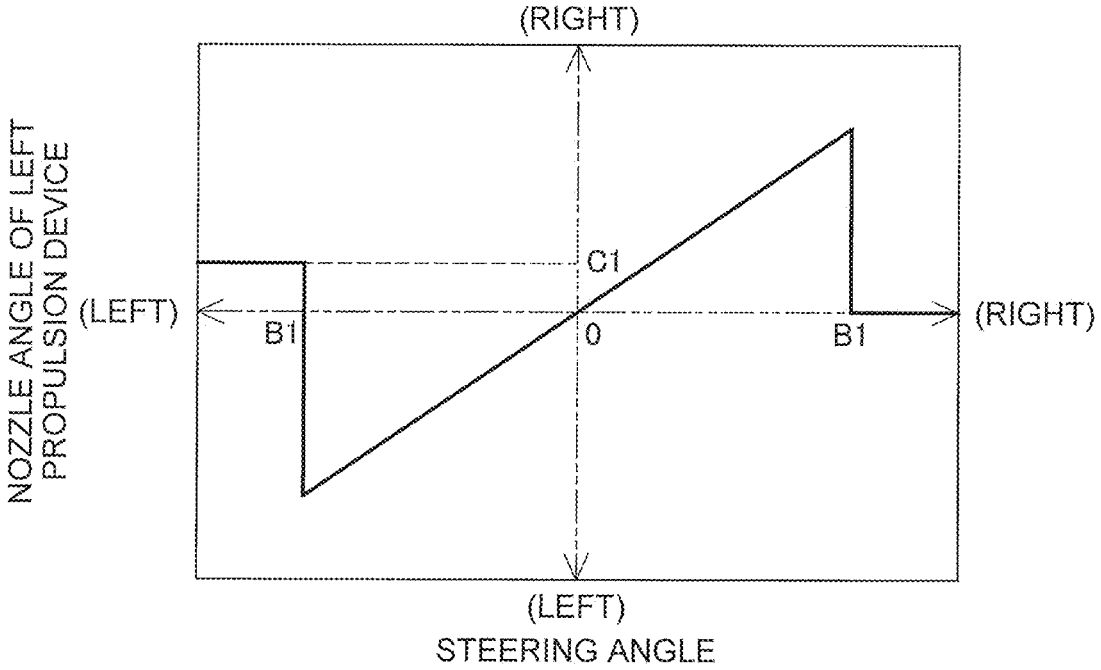
FIG. 9A is a chart showing a relationship established between the steering angle and the nozzle angle of the left propulsion device when engine rotational speed is less than a speed threshold.
Figure 9B:
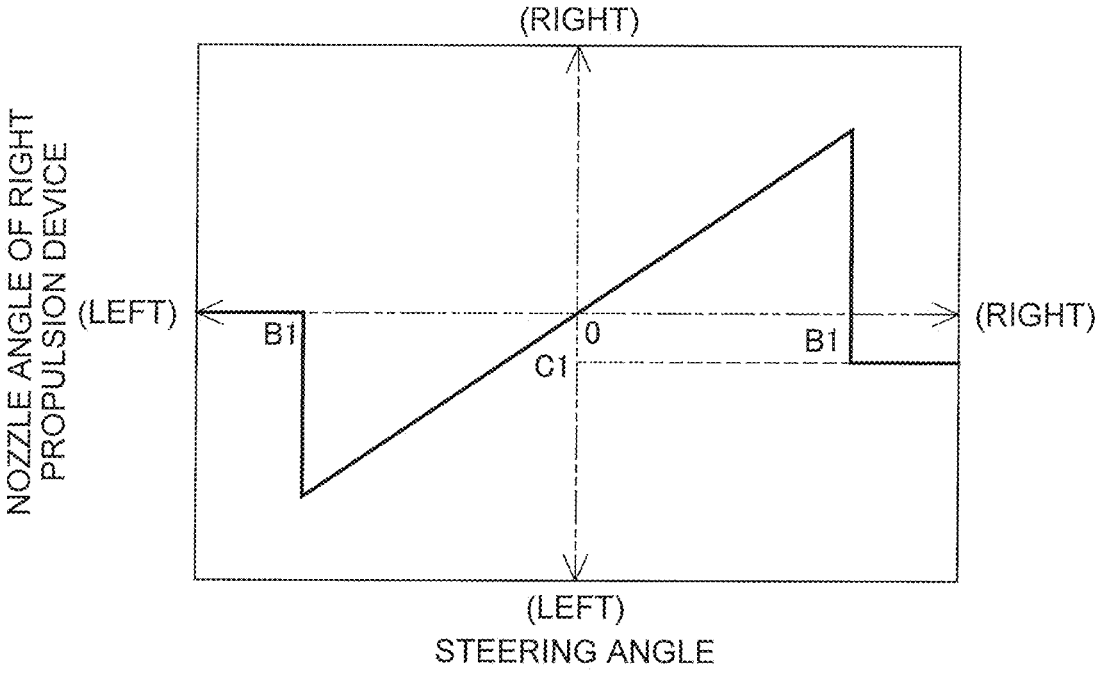
FIG. 9B is a chart showing a relationship established between the steering angle and the nozzle angle of the right propulsion device when the engine rotational speed is less than the speed threshold.

FIG. 9A is a chart showing a relationship established between the steering angle and the nozzle angle of the left propulsion device 3A when the engine rotational speed is less than the speed threshold A1. FIG. 9B is a chart showing a relationship established between the steering angle and the nozzle angle of the right propulsion device 3B when the engine rotational speed is less than the speed threshold A1.

The controller 10 executes the first steering control when the steering angle is less than the steering threshold B1 in the left turning direction. As shown in FIGS. 9A and 9B, during the first steering control, the controller 10 increases the nozzle angles of the left and right propulsion devices 3A and 3B leftward with an increase in the steering angle in the left turning direction. The controller 10 executes the second steering control when the steering angle is greater than or equal to the steering threshold B1 in the left turning direction. As shown in FIG. 9A, during the second steering control, the controller 10 sets the nozzle angle of the left propulsion device 3A to the predetermined angle C1 opening rightward. On the other hand, as shown in FIG. 9B, during the second steering control, the controller 10 sets the nozzle angle of the right propulsion device 3B to 0 degrees.

The controller 10 executes the first steering control when the steering angle is less than the steering threshold B1 in the right turning direction. As shown in FIGS. 9A and 9B, during the first steering control, the controller 10 increases the nozzle angles of the left and right propulsion devices 3A and 3B rightward with an increase in the steering angle in the right turning direction. The controller 10 executes the second steering control when the steering angle is greater than or equal to the steering threshold B1 in the right turning direction. As shown in FIG. 9A, during the second steering control, the controller 10 sets the nozzle angle of the left propulsion device 3A to 0 degrees. On the other hand, as shown in FIG. 9B, during the second steering control, the controller 10 sets the nozzle angle of the right propulsion device 3B to the predetermined angle C1 opening leftward.

In the watercraft 1 according to the present preferred embodiment, when the steering angle is greater than or equal to the steering threshold B1, the left and right propulsion devices 3A and 3B are caused to generate the thrusts F1 and F2 oriented in opposite directions in the back-and-forth direction such that the watercraft 1 is turned in a corresponding direction to the operating direction of the steering member 16. Accordingly, the turning performance of the watercraft 1 is enhanced in comparison to turning the watercraft 1 only by changing the nozzle angles.

Figure 10:
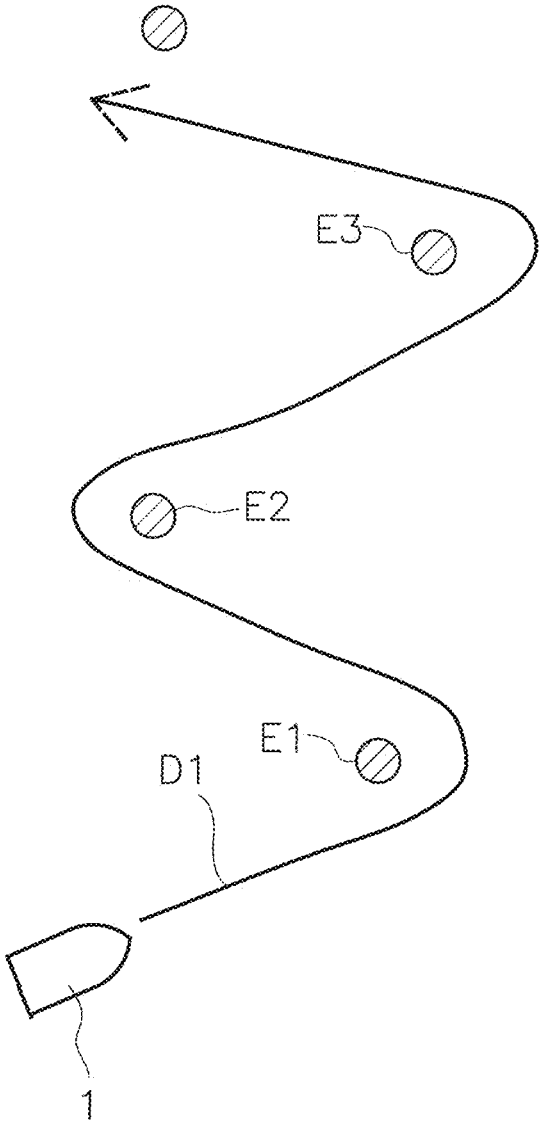
FIG. 10 is a diagram showing an example of a trajectory followed by the watercraft during a slalom operation.

For example, FIG. 10 is a diagram showing an example of a trajectory followed by the watercraft 1 during which a slalom operation is performed. In FIG. 10, solid line D1 indicates the trajectory of the watercraft 1 according to the present preferred embodiment.

Figure 11:
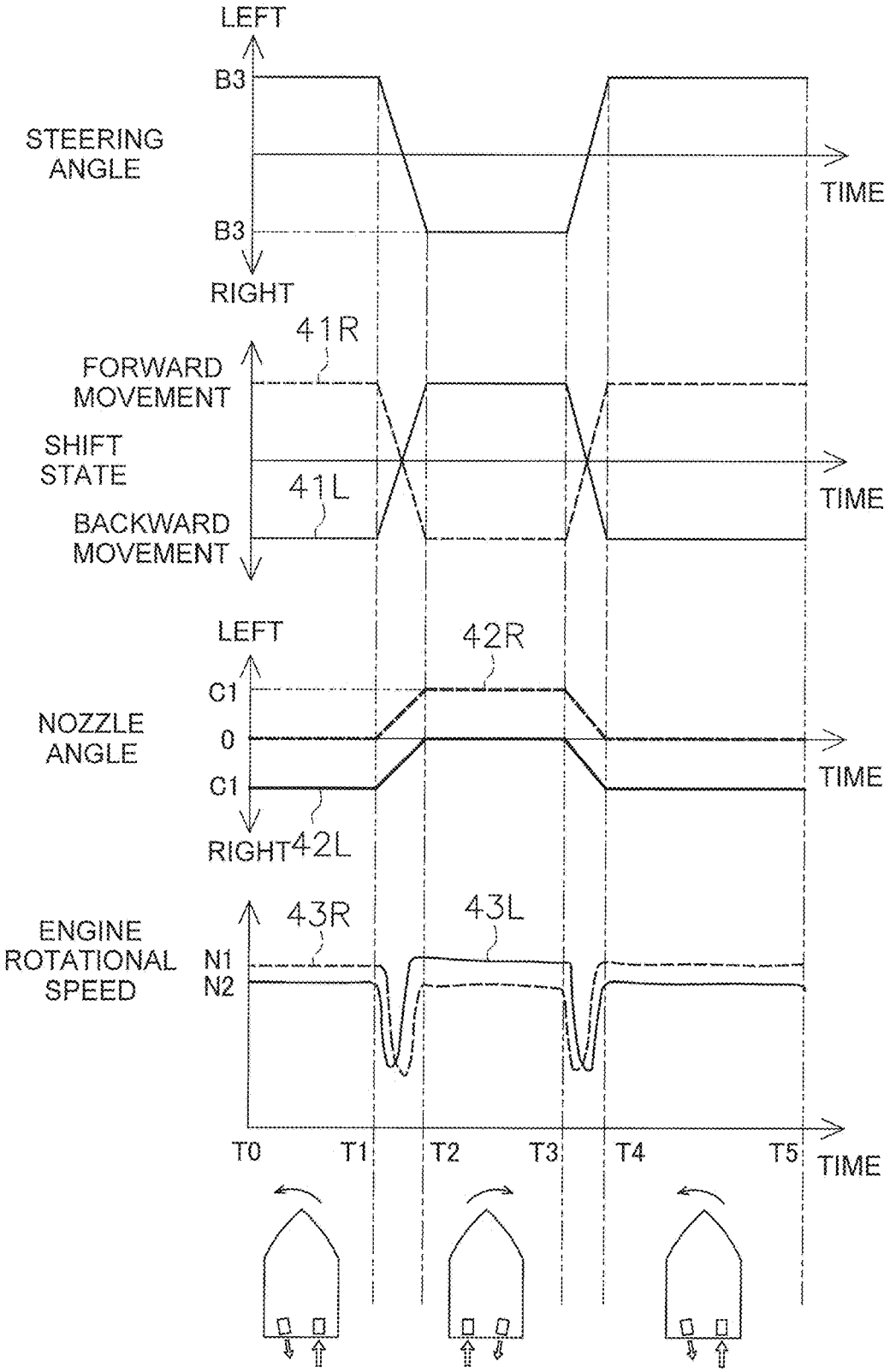
FIG. 11 is a timing chart showing a change in steering angle, shift state, nozzle angle, and engine rotational speed when performing the slalom operation of the watercraft.

FIG. 11 is a timing chart showing changes in steering angle, shift state, nozzle angle, and engine rotational speed when performing the slalom operation of the watercraft 1 according to the present preferred embodiment. In FIG. 11, solid line 41L indicates the shift state of the left propulsion device 3A. Broken line 41R indicates the shift state of the right propulsion device 3B. Solid line 42L indicates the nozzle angle of the left propulsion device 3A. Broken line 42R indicates the nozzle angle of the right propulsion device 3B. Solid line 43L indicates the engine rotational speed of the left engine 4A. Broken line 43R indicates the engine rotational speed of the right engine 4B.

In an interval from time T0 to time T1 shown in FIG. 11, the steering angle is an angle B3 opening in the left turning direction. The angle B3 is greater than the steering threshold B1. Therefore, the controller 10 sets the left propulsion device 3A to operate for backward movement, while setting the right propulsion device 3B to operate for forward movement. The controller 10 sets the nozzle angle of the left propulsion device 3A to the predetermined angle C1 opening rightward, while setting the nozzle angle of the right propulsion device 3B to 0 degrees. Additionally, the controller 10 keeps the engine rotational speed of the right engine 4B at N1 while keeping the engine rotational speed of the left engine 4A at N2 that is less than N1. Accordingly, as shown in FIG. 10, the watercraft 1 is turned left at a first target position E1.

In an interval from time T1 to time T2, the steering angle is changed from the angle B3 opening in the left turning direction to an angle B3 opening in the right turning direction. Accordingly, the controller 10 switches the left propulsion device 3A to operate for forward movement, while switching the right propulsion device 3B to operate for backward movement. Moreover, the controller 10 changes the nozzle angle of the left propulsion device 3A to 0 degrees, while changing the nozzle angle of the right propulsion device 3B to the predetermined angle C1 opening leftward. Furthermore, the controller 10 changes the engine rotational speed of the left engine 4A to N1 while changing the engine rotational speed of the right engine 4B to N2. Accordingly, in an interval from time T2 to time T3, the watercraft 1 is turned right at a second target position E2 as shown in FIG. 10. It should be noted that in the interval from time T1 to time T2, the controller 10 temporarily reduces the engine rotational speeds of the left and right engines 4A and 4B during switching the shift states of the left and right propulsion devices 3A and 3B. Accordingly, the first and second reverse gates 7A and 7B are smoothly switched in position.

In an interval from time T3 to time T4, the steering angle is changed from the angle B3 opening in the right turning direction to the angle B3 opening in the left turning direction. Accordingly, the controller 10 switches the left propulsion device 3A to operate for backward movement while switching the right propulsion device 3B to operate for forward movement. Moreover, the controller 10 changes the nozzle angle of the left propulsion device 3A to the predetermined angle C1 opening rightward while changing the nozzle angle of the right propulsion device 3B to 0 degrees. Furthermore, the controller 10 changes the engine rotational speed of the right engine 4B to N1 while changing the engine rotational speed of the left engine 4A to N2. In the interval from time T3 to time T4, the controller 10 temporarily reduces the engine rotational speeds of the left and right engines 4A and 4B during switching the shift states of the left and right propulsion devices 3A and 3B. Accordingly, in an interval from time T4 to time T5, the watercraft 1 is turned left at a third target position E3 as shown in FIG. 10. As described above, the watercraft 1 according to the present preferred embodiment has an enhanced turning performance.

In the above-described preferred embodiments, the left and right propulsion devices 3A and 3B are jet propulsion devices. However, the left and right propulsion devices 3A and 3B may be another type of propulsion device such as an outboard motor.

In the above-described preferred embodiments, during the first steering control, the controller 10 changes the nozzle angles right and left such that the watercraft 1 is turned. However, during the first steering control, the controller 10 may cause one of the left and right propulsion devices 3A and 3B to generate a different thrust from the other such that the watercraft 1 is turned in a direction corresponding to the operating direction of the steering member 16.

Figure 12A:
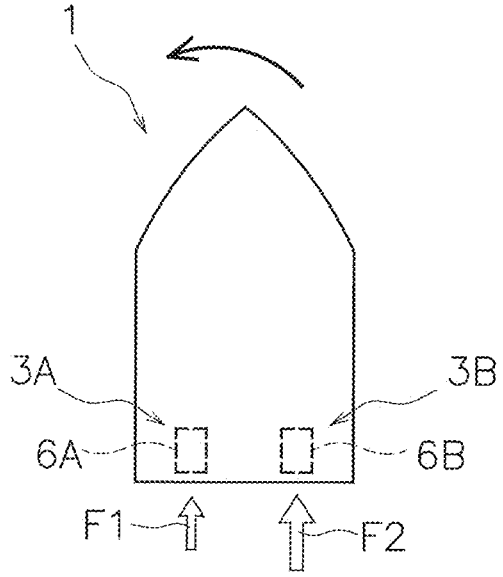
FIG. 12A is a diagram showing the thrusts and the nozzle angles of the right and left propulsion devices during the first steering control according to a first modified preferred embodiment of the present invention.
Figure 12B:
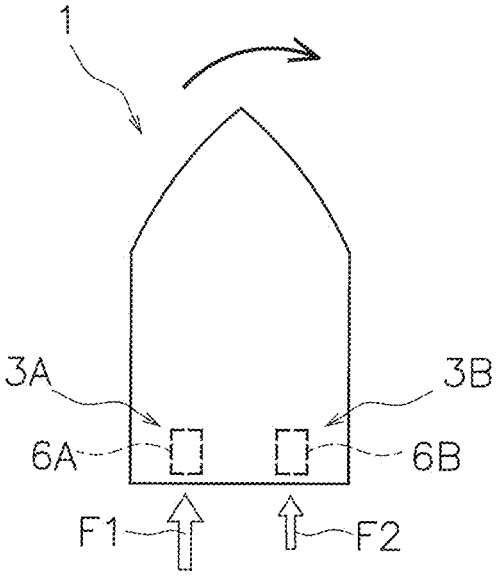
FIG. 12B is a diagram showing the thrusts and the nozzle angles of the right and left propulsion devices during the first steering control according to the first modified preferred embodiment of the present invention.

For example, as shown in FIG. 12A, the controller 10 may set the thrust F1 of the left propulsion device 3A to be less in magnitude than the thrust F2 of the right propulsion device 3B such that the watercraft 1 is turned leftward. As shown in FIG. 12B, the controller 10 may set the thrust F2 of the right propulsion device 3B to be less in magnitude than the thrust F1 of the left propulsion device 3A such that the watercraft 1 is turned rightward.

In the above-described preferred embodiments, during the first steering control, the controller 10 changes both the nozzle angles of the left and right propulsion devices 3A and 3B right and left such that the watercraft 1 is turned. However, during the first steering control, the controller 10 may change only one of the nozzle angles of the left and right propulsion devices 3A and 3B right and left such that the watercraft 1 is turned.

In the above-described preferred embodiments, during the second steering control, the second rotational speed is less than the first rotational speed in which the left propulsion device 3A generates the thrust F1 for forward movement and the right propulsion device 3B generates the thrust F2 for backward movement. When the first rotational speed is less than the second rotational speed, the right propulsion device 3B generates the thrust F1 for forward movement and the left propulsion device 3A generates the thrust F2 for backward movement. However, the first rotational speed may be equal to the second rotational speed.

Figure 13A:
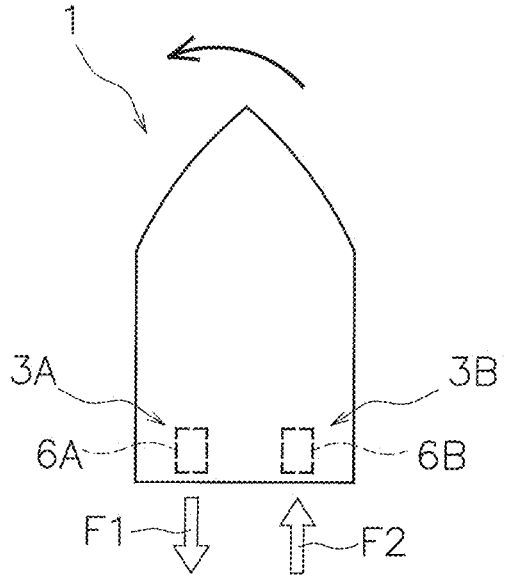
FIG. 13A is a diagram showing the thrusts and the nozzle angles of the right and left propulsion devices during the second steering control according to a second modified preferred embodiment of the present invention.
Figure 13B:
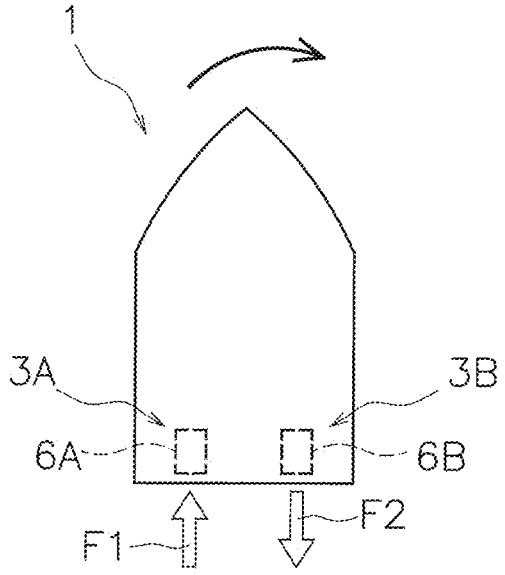
FIG. 13B is a diagram showing the thrusts and the nozzle angles of the right and left propulsion devices during the second steering control according to the second modified preferred embodiment of the present invention.

In the above-described preferred embodiments, during the second steering control, when the steering member 16 is operated in the left turning direction, the controller 10 sets the nozzle angle of the left propulsion device 3A to the predetermined angle C1 opening rightward while setting the nozzle angle of the right propulsion device 3B to 0 degrees. During the second steering control, when the steering member 16 is operated in the right turning direction, the controller 10 sets the nozzle angle of the right propulsion device 3B to the predetermined angle C1 opening leftward while setting the nozzle angle of the left propulsion device 3A to 0 degrees. However, as shown in FIG. 13A, during the second steering control, when the steering member 16 is operated in the left turning direction, the controller 10 may set both the nozzle angles of the left and right propulsion devices 3A and 3B to 0 degrees. Likewise, as shown in FIG. 13B, during the second steering control, when the steering member 16 is operated in the right turning direction, the controller 10 may set both the nozzle angles of the left and right propulsion devices 3A and 3B to 0 degrees.

The steering threshold B1 described above may be a fixed value. Alternatively, the steering threshold B1 may be variable. For example, the controller 10 may make the steering threshold B1 vary in accordance with the engine rotational speed.

In the above-described preferred embodiments, during the second steering control, the nozzle angle of the propulsion device for backward movement is set to the predetermined angle C1. The predetermined angle C1 may be a fixed value. Alternatively, the predetermined angle C1 may be variable. For example, the controller 10 may make the predetermined angle C1 vary in accordance with the engine rotational speed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft comprising:

a vessel body;

a left propulsion device attached to the vessel body;

a right propulsion device attached to the vessel body;

a steering member operable from a neutral position in a left turning direction and a right turning direction;

a sensor to output a signal indicating an operating amount and an operating direction of the steering member from the neutral position; and a controller in communication with the left propulsion device, the right propulsion device, and the sensor, the controller being configured or programmed to:

receive the signal indicating the operating amount and the operating direction of the steering member; and when the operating amount of the steering member is greater than or equal to a steering threshold having an angle greater than zero degrees, cause the right propulsion device and the left propulsion device to generate thrusts oriented in opposite directions in a back-and-forth direction such that the vessel body is turned in a direction corresponding to the operating direction of the steering member.

2. The watercraft according to claim 1, wherein when the operating amount of the steering member is less than the steering threshold, the controller is configured or programmed to cause the right propulsion device and the left propulsion device to generate thrusts oriented in an identical direction.

3. The watercraft according to claim 2, wherein when the operating amount of the steering member is less than the steering threshold, the controller is configured or programmed to cause at least one of the right propulsion device and the left propulsion device to change the direction of the thrust generated therefrom in a right-and-left direction such that the vessel body is turned in the direction corresponding to the operating direction of the steering member.

4. The watercraft according to claim 2, wherein when the operating amount of the steering member is less than the steering threshold, the controller is configured or programmed to cause one of the right propulsion device and the left propulsion device to generate a different thrust from the other such that the vessel body is turned in the direction corresponding to the operating direction of the steering member.

5. The watercraft according to claim 1, wherein the left propulsion device includes a left engine;

the right propulsion device includes a right engine;

when engine rotational speeds of the right engine and the left engine are both greater than or equal to a speed threshold, the controller is configured or programmed to cause the right propulsion device and the left propulsion device to generate thrusts oriented in an identical direction and to cause at least one of the right propulsion device and the left propulsion device to change the direction of the thrust generated therefrom in a right-and-left direction such that the vessel body is turned in the direction corresponding to the operating direction of the steering member; and when the engine rotational speeds of the right engine and the left engine are both less than the speed threshold and the operating amount of the steering member is greater than or equal to the steering threshold, the controller is configured or programmed to cause the right propulsion device and the left propulsion device to generate the thrusts oriented in the opposite directions in the back-and-forth direction such that the vessel body is turned in the direction corresponding to the operating direction of the steering member.

6. The watercraft according to claim 1, wherein the left propulsion device includes a left engine;

the right propulsion device includes a right engine;

the watercraft further comprises a throttle member operable to control at least one of an engine rotational speed of the right engine and an engine rotational speed of the left engine; and when the operating amount of the steering member is greater than or equal to the steering threshold, the controller is configured or programmed to keep the engine rotational speed of the left engine constant at a first rotational speed and keep the engine rotational speed of the right engine constant at a second rotational speed regardless of an operating amount of the throttle member.

7. The watercraft according to claim 6, wherein the controller is configured or programmed to set the second rotational speed to be lower than the first rotational speed when the left propulsion device generates the thrust for forward movement and the right propulsion device generates the thrust for backward movement.

8. The watercraft according to claim 6, wherein the controller is configured or programmed to set the first rotational speed to be lower than the second rotational speed when the left propulsion device generates the thrust for backward movement and the right propulsion device generates the thrust for forward movement.

* * * * *